US005722443A

United States Patent [19]

Marler et al.

[11] Patent Number: 5,722,443

[45] Date of Patent: Mar. 3, 1998

[54] PARTS WASHER CABINET SEALING SYSTEM

[75] Inventors: Ted Marler, Bridgeton; Marc Treppler, St. Louis, both of Mo.

[73] Assignee: The Mart Corporation, Maryland Heights, Mo.

[21] Appl. No.: 298,452

[22] Filed: Aug. 30, 1994

[51] Int. Cl.[6] ..... B08B 15/00

[52] U.S. Cl. ..... 134/114; 134/200; 134/201

[58] Field of Search ..... 134/57 D, 56 D, 134/58 D, 200, 114, 201; 277/56, 53, 55; 49/483.1, 400

[56] References Cited

U.S. PATENT DOCUMENTS 4,143,669 3/1979 Minkin .
4,741,351 5/1988 Minkin .
5,277,208 1/1994 Mansur .

*Primary Examiner*—Frankie L. Stinson
*Attorney, Agent, or Firm*—Wood, Phillips, VanSanten, Clark & Mortimer

[57] ABSTRACT

A parts washer is provided having a cabinet defining an interior space and a mechanism for entraining a liquid and/or vapor in the interior space. The cabinet defines an opening for accessing the interior space from externally of the cabinet. Mounting structure is provided for mounting a closure element to the cabinet for movement selectively between a) an open position wherein the interior space can be accessed through the cabinet opening and b) a closed position. Structure is provided cooperating between the closure element and the cabinet for defining a controlled flow path for the liquid and/or vapor in the interior space with the control flow path configured so that at least one of the liquid and vapor in the interior space is caused to change directions as it traverses the controlled flow path.

19 Claims, 11 Drawing Sheets

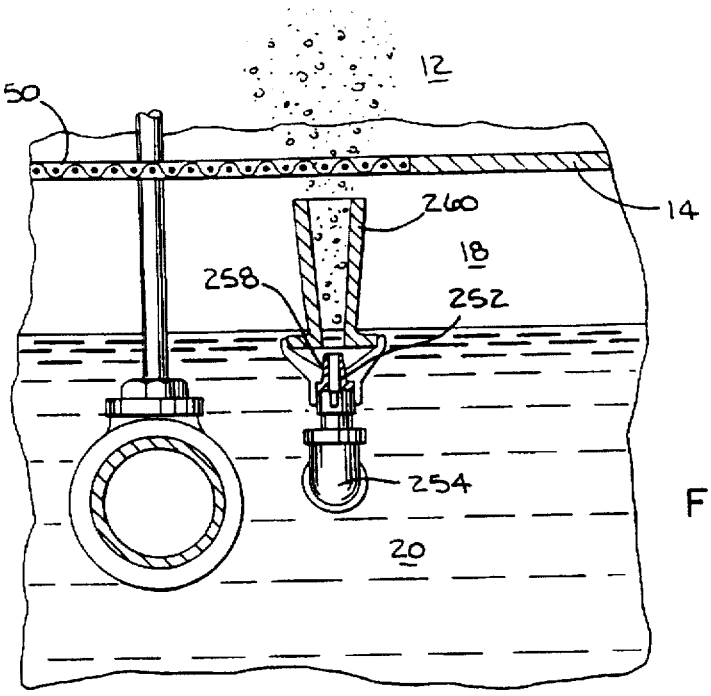
FIG. 15
FIG. 16
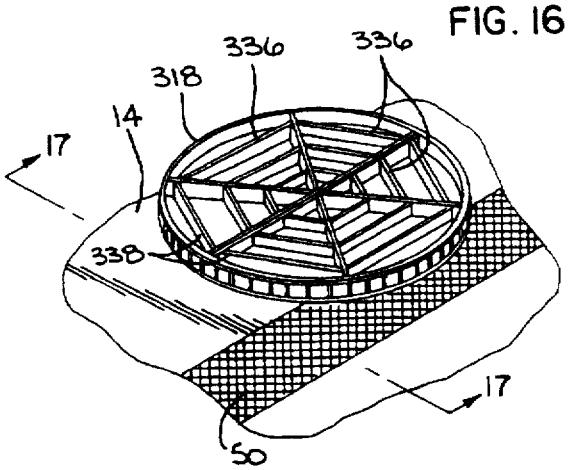
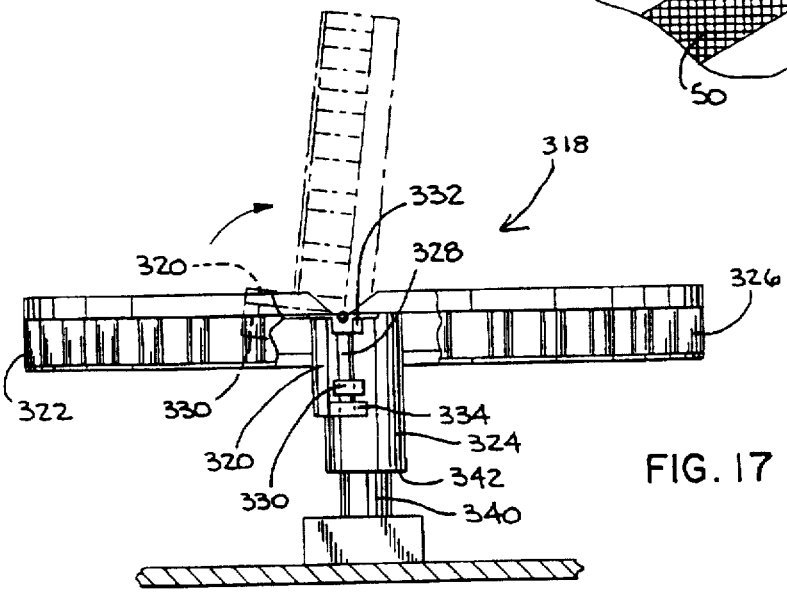
FIG. 17

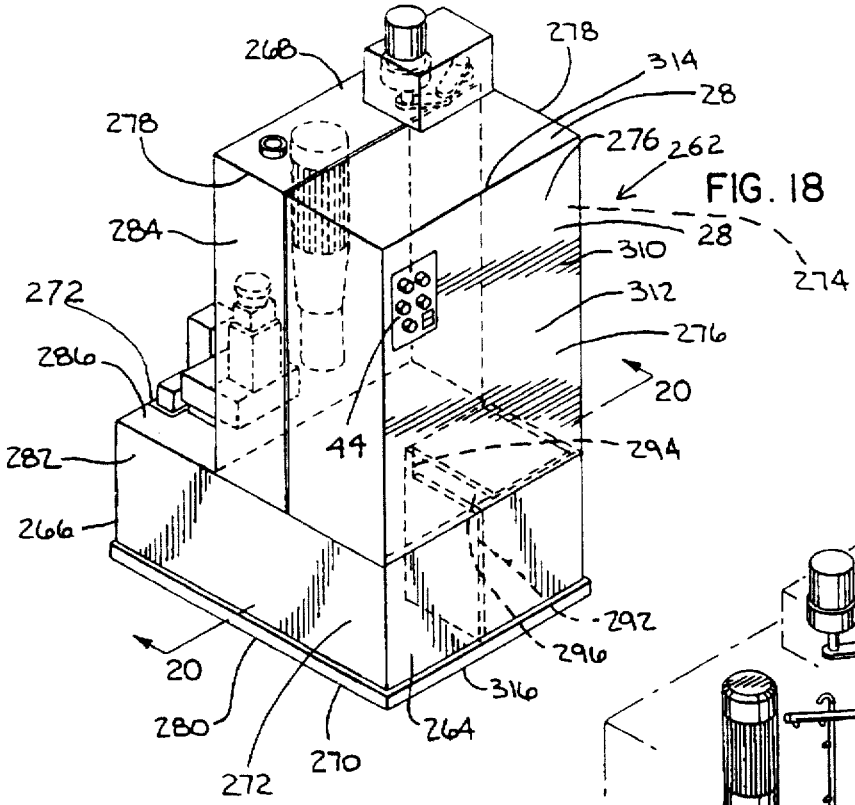
FIG. 18
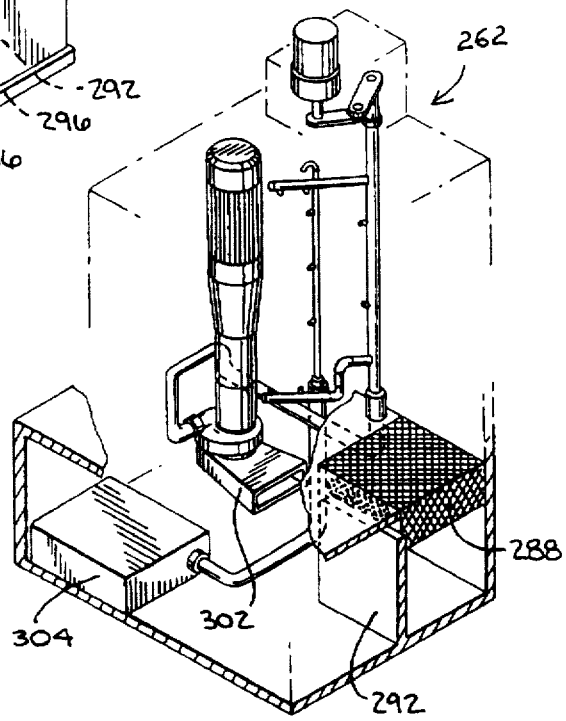
FIG. 19
FIG. 20
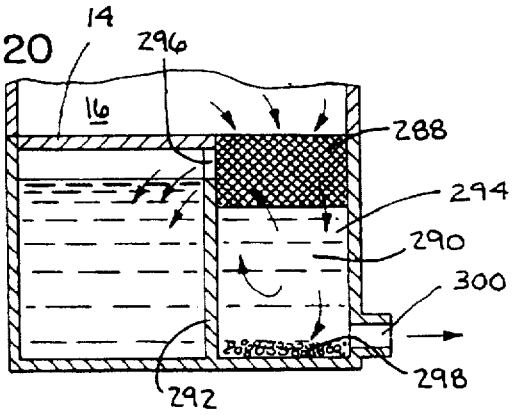

PARTS WASHER CABINET SEALING SYSTEM

FIELD OF THE INVENTION

This invention relates to parts washers and, more particularly, to cabinet sealing systems used with parts washers.

BACKGROUND OF THE INVENTION

Generally, parts washers have a cabinet having an opening therein through which a parts supporting mechanism can be moved to load parts into the cabinet for washing thereof and to remove parts from the cabinet after a washing. The washing involves the use of a high pressure heated cleaning fluid which is directed at parts in the cabinet for cleaning thereof. Hence, there is a need to seal the cabinet opening during a cleaning cycle from pressurized heated cleaning fluid from leaking out of the cabinet and from the low pressure steam generated by the pressurized heated spray from bellowing out of the cabinet. These sealing problems have been exacerbated by the use of increasingly higher pump pressures in parts washers.

Some parts washers utilize elastomeric material attached to the door to seal the cabinet opening. However, because the cleaning fluid is hot and generally has cleaning agents/chemicals added thereto, the hot cleaning fluid contacting the elastomeric gaskets tends to cause the elastomeric material to deteriorate thereby causing leaking of steam and liquid from the cabinet. Further, replacing elastomeric materials on the door causes the parts washer operator significant inconvenience.

To avoid this, steel to steel compression seals have been employed. The compression seals are provided by flanges extending from the door and flanges extending from the cabinet near the opening thereof such that a seal is produced. While this avoids the use of elastomeric or resilient materials, the compression seals are not completely water tight and rely on precise manufacture thereof as the tolerances to produce these contacting flanges are extremely tight.

SUMMARY OF THE INVENTION

The present invention is specifically directed to overcoming the above enumerated problems in a novel and simple manner.

According to the invention, a parts washer is provided having a cabinet defining an interior space and a mechanism for entraining a liquid and/or vapor in the interior space. The cabinet defines an opening for accessing the interior space from externally of the cabinet. Mounting structure is provided for mounting a closure element to the cabinet for movement selectively between a) an open position wherein the interior space can be accessed through the cabinet opening and b) a closed position. Structure is provided cooperating between the closure element and the cabinet for defining a controlled flow path for the liquid and/or vapor in the interior space with the control flow path configured so that at least one of the liquid and vapor in the interior space is caused to change directions as it traverses the controlled flow path.

Preferably, the cooperating structure includes a flange on one of the closure element and the cabinet with the flange having a transverse leg that intercepts flow of the liquid and/or vapor from the interior space to create turbulent movement of the liquid and/or vapor traversing the controlled flow path. The controlled flow path can extend from the interior space to externally of the cabinet.

In a preferred form, the cooperating structure includes a plurality of cooperating flanges defining at least portion of the controlled flow path, with the flanges being arranged so that either the liquid or the vapor in the controlled flow path portion moves in a circuitous path against the cooperating flanges. Preferably, at least the portion of one of the cooperating flanges has a flow guiding surface oriented to direct accumulated liquid thereon by gravity inwardly of the cabinet.

In another preferred form, the cooperating structure includes cooperating surfaces on the closure element and cabinet that define a space therebetween which define part of the flow path that can be at least partially sealed by liquid from the interior space to thereby at least partially block movement of liquid and vapor in the controlled flow path through the space. Preferably, a plurality of spaces are provided and arranged such that the spaces progress from a space proximate the cabinet opening to a space distal from the cabinet opening. Even more preferably, the closure element is provided with a border area and the cabinet with a frame mounted to the cabinet around the opening thereof with at least one flange extending from one of the border area and the frame and with the cooperating surfaces being on the flange and one of the border area and the frame in closely spaced relation to each other.

Even more preferably, the flange comprises a plurality of flanges on the border area and a plurality of flanges on the frame wherein the flanges with the frame and border area cooperate to form a series of chambers, such that adjacent chambers are in fluid communication with each other through the spaces. The chambers progress from a chamber proximate the cabinet opening to a chamber distal from the cabinet opening. The proximate space is capable of providing the cabinet interior space fluid access to the proximate chamber and the distal space is capable of providing the distal chamber fluid access to an exterior of the cabinet.

Preferably, the flange, the border area and the frame are made from a non-resilient material.

In another exemplary embodiment, the parts washer is provided having structure on the closure element for cooperating with the cabinet to define a control flow path for fluid in the cabinet interior space with the control flow path configured so that fluid in the interior space is caused to change direction as it traverses the controlled flow path.

Other objects, advantages and features of the present invention will become apparent from a consideration of the following specification taken in conjunction with the accompanying drawings.

BRIEF DESCRIPTION OF DRAWINGS

FIG. 15 is an enlarged elevation view of a nozzle and a diffuser in section illustrating a spray of fluid discharged therefrom;

FIG. 16 is an enlarged perspective view of a parts supporting fold-up turntable that can be used in both the inventive parts washer and an inventive reduced footprint parts washer;

FIG. 17 is an enlarged view of the fold-up turntable in a non-pivoted position illustrated in solid lines and in a pivoted position illustrated in broken lines;

FIG. 18 is a perspective view of the inventive reduced footprint parts washer having a control box and operating mechanisms which are partially illustrated with broken lines;

FIG. 19 is a perspective view of the inventive reduced footprint parts washer with the cabinet partially in broken lines and the turntable removed;

FIG. 20 is an enlarged cross-sectional view of a fluid holding space with a settling chamber and a filter basket taken along line 20—20 in FIG. 18;

DETAILED DESCRIPTION OF THE DRAWINGS

Figure 1:
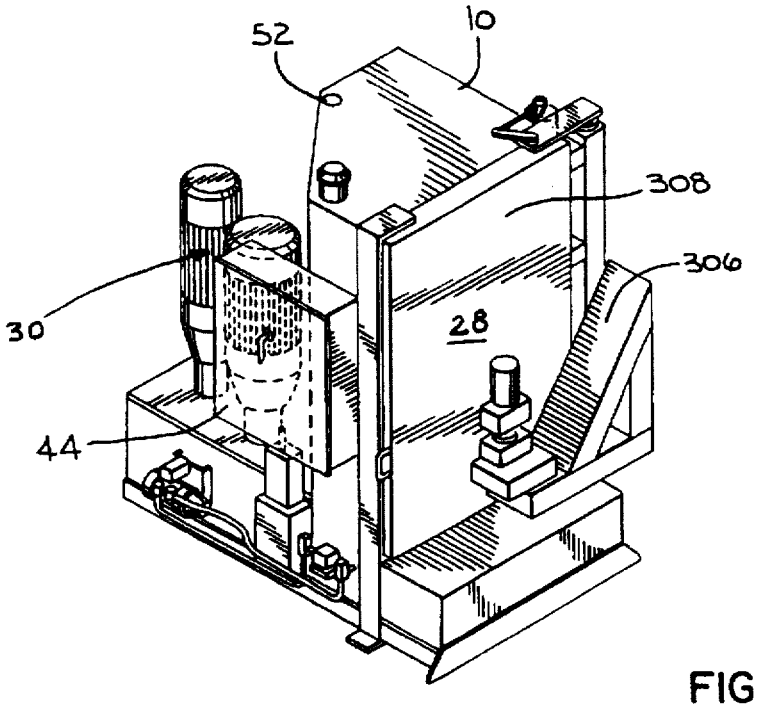
FIG. 1 is a perspective view of a parts washer having a cabinet according to the invention.

The following is a specific description of the features and operation of one design of a parts washer having coordinated subsystems separately described herein. The parts washer is shown generally in FIGS. 1–3 and has a cabinet, indicated generally at 10. The cabinet 10 defines an internal space 12 which is generally divided by a false floor 14 into a parts washing chamber 16 and a fluid holding space 18 with a portion thereof retaining cleaning fluid 20 (FIG. 15).

A portion of the fluid holding space 18 extends forwardly beyond the parts washing chamber 16 in the form of an access reservoir 22 outside the internal space 12. A heat source 24 is utilized to heat cleaning fluid 20 in the fluid holding space 18. The heat source 24 can generate heat to heat the cleaning fluid 20 in a variety of different manners such as by gas heat, electrical heat, or steam heat.

The cabinet 10 has an opening 26 therein for accessing the internal space 12. The opening 26 is disposed above the fluid holding space 18. A hinged door 28 is mounted to the cabinet 10 for closing the opening 26 during operation of the parts washer.

A pump system 30 is utilized to provide pressurized heated fluid 20 to a wash manifold 32. The wash manifold 32 has several nozzles 34 mounted thereon which direct pressurized, heated cleaning fluid at parts in the washing chamber 16. Parts are generally supported in the washing chamber 16 by either a turntable 36 or a tumbler 38 (FIG. 12) that can be mounted to an inside surface 40 of the door 28.

Water is supplied to the cabinet 10 from a fresh water source (not shown). The water is either supplied directly to the fluid holding space 18 or to a rinse manifold 42. Cleaning agents can be added to the water in the fluid holding space 18 through the access reservoir 22.

To operate the parts washer, the heat source 24 and the wash and rinse times are manually preset at a control box 44. The control box 44 has manual controls for automatically controlling the temperature of the cleaning fluid 20 and the duration of the wash and rinse cycles.

Initially, the fluid holding space 18 is filled with water from a fresh water source to a set point in the fluid holding space 18. Appropriate chemicals can then be added to the access reservoir 22 as previously described. The heat source 24 includes a duct 46 having heated air flowing therethrough and transfers heat to the fluid 20 in the fluid holding space 18. A flue pipe 48 is provided for exhausting combustion gases in the duct 46.

The pump system 30 is activated to take cleaning fluid 20 from the fluid holding space 18 and provide high pressure heated cleaning fluid to the wash manifold 32. The nozzles 34 on the wash manifold 32 direct the pressurized cleaning fluid to against parts supported on the turntable 36 or the tumbler 38, both of which are capable of rotating in the washing chamber 16 to ensure thorough cleaning of the parts. The cleaning fluid 20 returns to the fluid holding space 18 after impacting against the parts through a perforate section 50 of the false floor 14.

The cabinet 10 can be provided with a steam exhaust 52 such that low pressure steam, produced during the wash cycle by operation of the heat source 24 and the pump 30 the wash manifold system 32, can be discharged from the internal space 12, thereby lowering the volume of the water portion of the cleaning fluid 20 in the fluid holding space 18.

After a wash cycle, the rinse system is started to remove residue remaining on the parts after a wash cycle. The length of a rinse cycle can be set based on the concentration of cleaning agents in the cleaning fluid 20 so that the set rinse time increases with higher concentrations of cleaning agents in the cleaning fluid 20. The rinse system gets its supply of fluid from a fresh water source so that operation of the rinse system adds fluid to the fluid holding space 18 as described below.

During a rinse cycle, the fresh water source supplies water to a rinse heat exchanger 56 in the fluid holding space 18 such that the heated fluid can transfer heat to the water in the rinse heat exchanger 56. Heated water from the rinse heat exchanger 56 is supplied to the rinse manifold 42 having nozzles 58 thereon for directing rinse water to against the parts in the washing chamber 16. Rinse water returns to the fluid holding space 18 through the perforate section 50 of the false floor 14 in the same manner as the pressurized heated fluid 20, thereby increasing the volume of cleaning fluid 20 in the fluid holding space 18. The wash and rinse cycles can be repeated, if desired.

The following is a detailed description of various subsystems of the parts washer described above. While the subsystems described below can be utilized with the parts washer described above, they can also be utilized with parts washers of other designs as one skilled in the art will appreciate.

Fluid Level Control System

Figure 4:
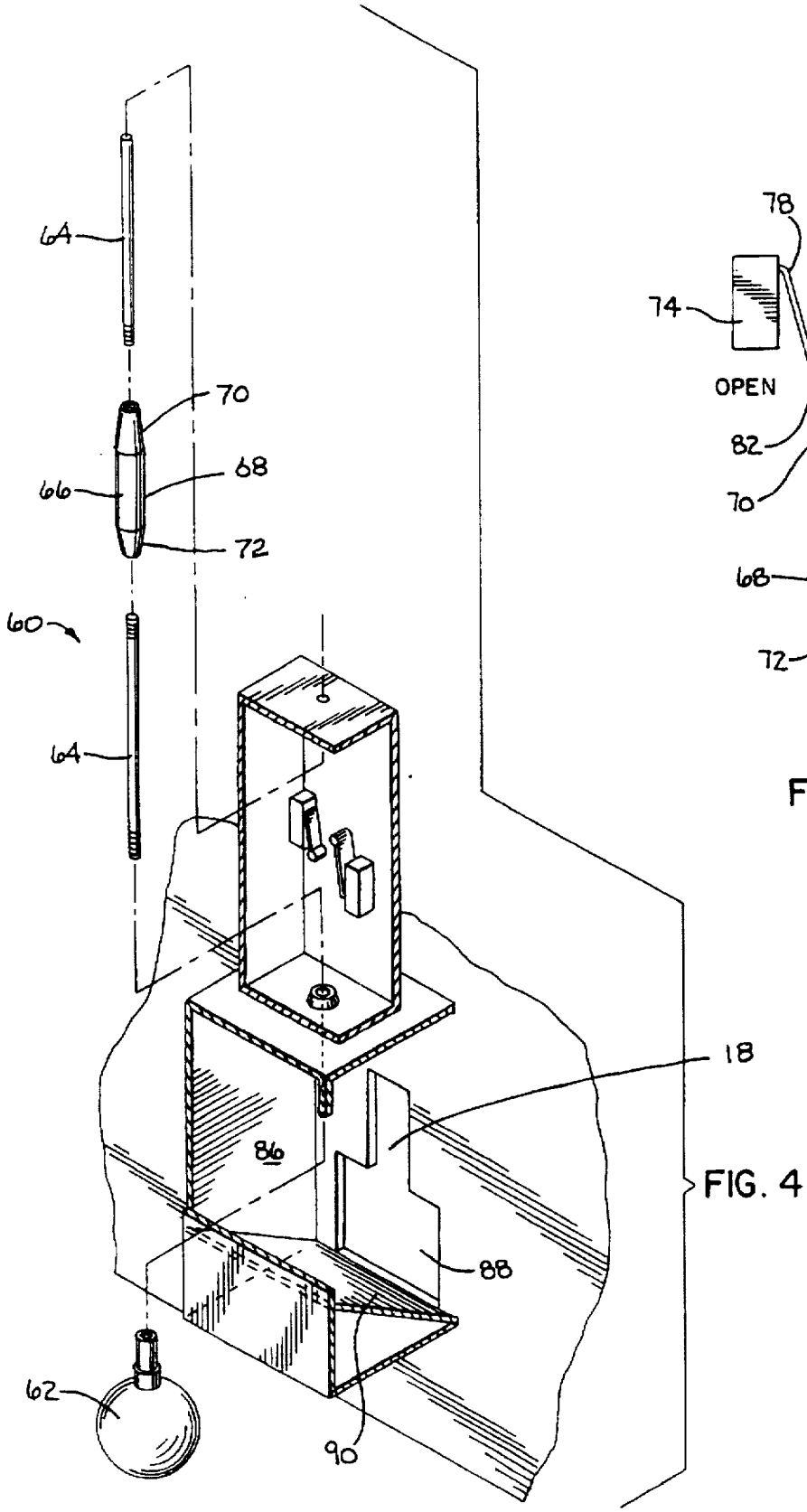
FIG. 4 is an enlarged, exploded perspective view of an independent reservoir chamber and a float assembly for controlling various parts washer functions based on the volume of fluid in the reservoir chamber.
Figure 5A:
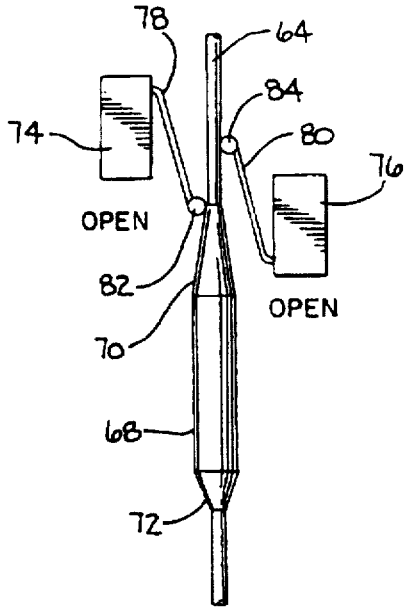
FIGS. 5A–5D are enlarged side elevation views of the float assembly in four different states in relationship to separate switches operated by the float assembly.

Referring to FIGS. 4 and 5A, the parts washer is provided with sensing means in the form of a float assembly 60. The float assembly 60 includes a ball float 62 attached to a weighted float red 64 and having an enlarged torpedo-shaped actuating element 66 mounted on the red 64 at a location spaced above the ball float 62. The actuating element 66 has a central cylindrical section 68 which blends into upper and lower tapered sections 70 and 72, respectively.

The ball float 62 rises and falls as the volume of cleaning fluid 20 in the fluid holding space 18 varies. The actuating element 66 acts as a counterbalance to the ball float 62 so that the float assembly 60 can accurately measure the volume of cleaning fluid 20 in the fluid holding space 18 even when the cleaning fluid 20 is heavily contaminated with grit, sludge and the like, such as after several wash and rinse cycles.

The float assembly 60 is further provided with upper and lower switches 74 and 76, respectively, positioned on either side of the red 64. The switches 74, 76 each include a resilient trigger member 78, 80, respectively, extending towards the red 64 with the members each having a circular element 82 and 84, respectively, which is biased by the member into slidable engagement with either the rod 64 or the actuating element 66, depending on the volume of cleaning fluid 20 in the fluid holding space 18.

An independent reservoir chamber 86 is provided in fluid communication with the fluid holding space 18. An inverted T-shaped slot 88 is defined in the cabinet 10 through which cleaning fluid 20 can gain access to the independent reservoir chamber 86. The independent reservoir chamber 86 has a sloped bottom surface 90 such that grit, sludge and the like in the cleaning fluid 20 will tend to slide down out of the independent reservoir chamber 86, through the lower portion of the inverted T-slot 88 and back into the fluid holding space 18 to avoid build-up of such contaminants on the float assembly components as may inhibit an accurate reading of the cleaning fluid volume in the fluid holding space 18. The upper portion of the inverted T-slot 88 allows floating oils, scum and the like to float out of the reservoir chamber 86. The inverted T-slot 88 is provided with a small cross-sectional area to inhibit the formation of waves in the independent reservoir chamber 86 thereby diminishing the response of the switches 74 and 76 to wave action in the fluid holding space 18.

The use of the torpedo-shaped actuating element 66 with only two switches 74, 76, allows four different fluid level indicating positions to be obtained. These four positions result from four different predetermined fluid volumes or banks of fluid in the fluid holding space 18. Operation of the parts washer using the float assembly 60 will now be described with reference to FIGS. 5A–5D.

In FIG. 5A, a "low—low" position is illustrated with both switches 74, 76 in the open position. The float assembly senses the "low—low" position when the upper switch member 78 is in contact with the rod 64 or has just contacted the upper tapered section 70 and therefore is still in the open position. In the "low—low" position, the lower switch member 80 is in contact with the rod 64 and therefore is likewise in the open position.

The "low—low" position occurs before the parts washer is started and the fluid holding space 18 is empty or during operation of the parts washer when during the wash cycle, the steam exhaust 52 has pulled out a large amount of low vapor steam from the internal space 12 of the cabinet 10.

When the float assembly 60 senses that the volume of cleaning fluid 20 is in the "low—low" position, the float assembly 60, through the switches 74 and 76, will disable the heat source 24 and the pump system 30. In the "low—low" position, the fluid volume in the fluid holding space 18 is insufficient to keep the pump inlets 112, 114 and the rinse heat exchanger 56 submerged in cleaning fluid 20. The float assembly 60 thus prevents the pump system 30 from intaking air as opposed to cleaning fluid 20, and thus protects the rinse heat exchanger 56 from burn-out.

Figure 3:
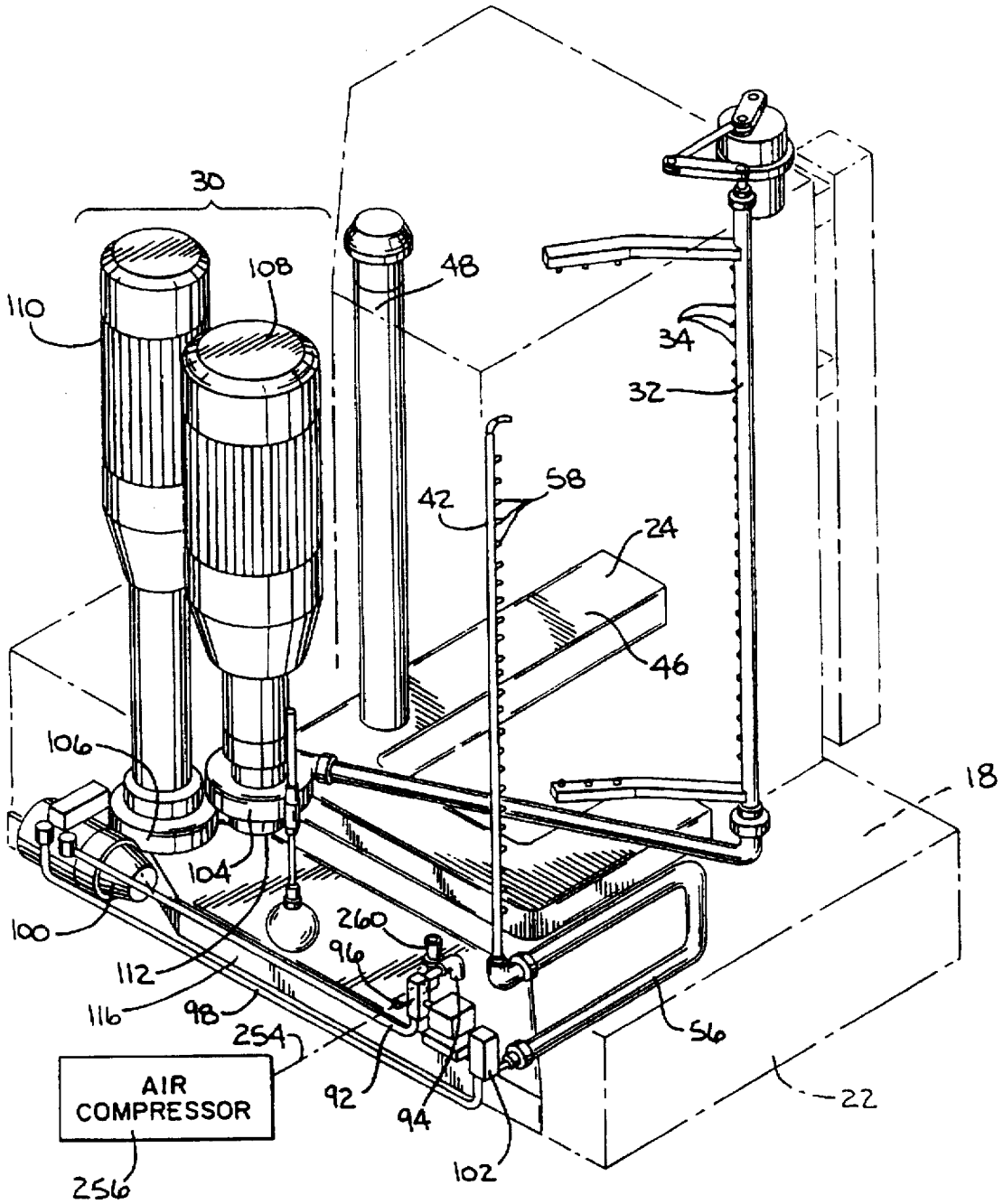
FIG. 3 is an enlarged perspective view of the inventive parts washer with the cabinet in broken lines and the door and the turntable removed.

Likewise, in the "low—low" position, the float assembly 60 through the switches 74, 76 automatically causes a water-fill supply line 92 to supply water to the fluid holding space 18. Referring to FIG. 3, the water-fill supply line 92 is connected to a spout 94 mounted in the cabinet 10 and to a fresh water source (not shown) to provide water-fill to the fluid holding space 18 by activating and opening a solenoid valve 96 for the waterfill supply line 92. In the "low—low" position, the float assembly 60 will also enable operation of the rinse manifold 42 through a separate rinse water supply line 98. The rinse water supply line 98 receives water from the fresh-water source after it has been pressurized through a rinse pump 100 to thereby provide pressurized water to the rinse heat exchanger 56. In the "low—low" position, a separate solenoid valve 102 for the pressurized rinse supply line 98 is activated to an open position.

Figure 5B:
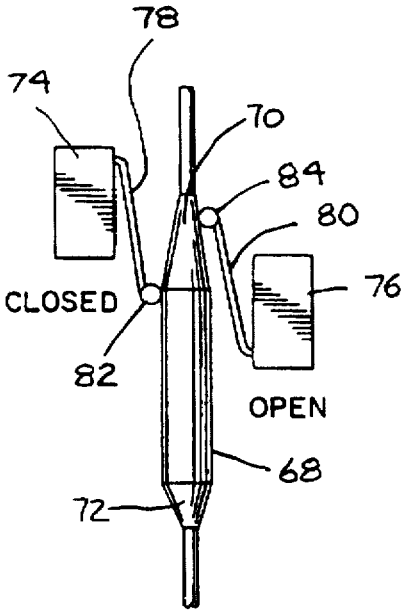

A minimum safe operating condition exists when the rinse heat exchanger 56 and the pump inlets 112, 114 fully submerged in cleaning fluid 20 in the fluid holding space 18. This is the "low" position and is sensed by the float assembly 60 when the upper switch member 78 has traversed the upper tapered section 70 sufficiently that the upper switch 74 is in the closed position and the lower switch member 80 is in contact with the red 64 or has just contacted the upper tapered section 70 so that the lower switch 76 is still in the open position, as shown in FIG. 5B.

When the float assembly 60 senses that the volume of cleaning fluid 20 is in the "low" position, the float assembly switches 74 and 76 enable operation of the heat source 24, the pump system 30, and the rinse manifold 42. Likewise, when either the pump system 30 or rinse manifold 42 is not operating in a cleaning cycle, the solenoid valve 96 for the water-fill supply line 92 is activated to an open position so that fresh water is provided to the cleaning fluid holding space 18, thereby increasing the volume of cleaning fluid 20 in the cleaning fluid holding space 18.

Figure 5C:
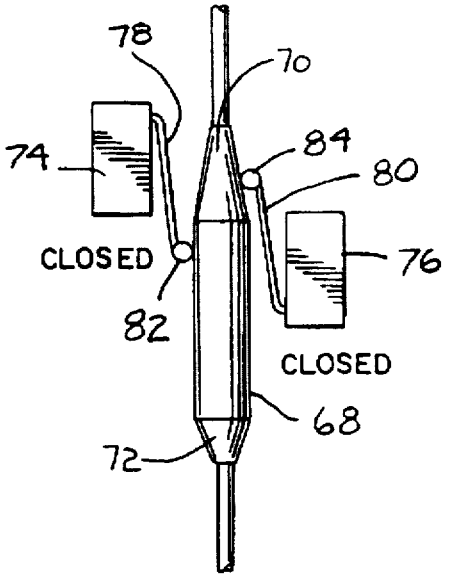
Figure 5D:
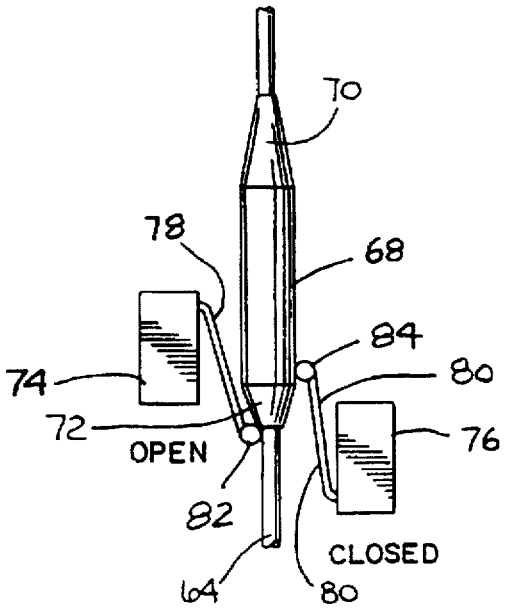

The water-fill supply line 92 will supply water to the holding space 18 until the volume of fluid 20 in the fluid holding space 18 reaches a "set point" position. At the "set point" position, both switches 74, 76 are in a closed position so that both switch members 78 and 80 will be in contact with the torpedo-shaped actuating element 66. The upper switch member 78 will have progressed to a point further down along the actuating element 66 than its position during the "low" position on the actuating element 66 and the lower switch member 80 will now be in engagement with the upper tapered section 70 of the actuating member 66 and will have traversed the upper tapered section 70 sufficiently so that the lower switch 76 is in a closed position, as shown in FIG. 5C.

When the volume of cleaning fluid 20 in the fluid holding space 18 is at the "set point" position, the float assembly switches 74 and 76 act to automatically shut down the water-fill supply line 92 by closing the associated solenoid valve 96. The rinse supply line 98 is enabled so that the associated solenoid valve 102 can be open thus allowing operation of the rinse manifold 42 above the "set point" position. In addition, both the heat source 24 and the pump system 30 can operate at and above the "set point."

When the rinse manifold 42 is operated above the "set point", the fluid volume in the fluid holding space 18 increases. The maximum fluid volume elevates the float assembly 60 to a "high" position, shown in FIG. 5D. In the "high" position, the upper switch member 78 is either contacting the lower tapered section 72 of the actuating element 66 at a point just before it reaches the red 64 or is contacting the red 64 and is in the open position. The lower switch member 80 is in the closed position and is in contact with the central cylindrical section 68 of the actuating element 66.

In the "high" position, the float assembly switches 74 and 76 will close both solenoid valves 96 and 102 for the water-fill supply line 92 and the rinse water supply line 98, respectively, such that the volume of fluid 20 in the fluid holding space 18 cannot be increased unless malfunctioning occurs. In the "high" position, the float assembly switches 74 and 76 enable operation of both the heat source 24 and the pump system 30 such that the steam exhaust 52 will remove low pressure steam from the cabinet internal space 12 to thus lower the volume of fluid 20 in the fluid holding space 18. Likewise, when the float assembly 60 senses a "high" position, the switches 74 and 76 can be designed to activate a light or alarm to indicate that a maximum solution level in the fluid holding space 18 has been reached.

Hence, through use of the float assembly 60 described above, four different system states can be realized based on different, predetermined fluid volumes or banks, so that in each state various fluid control mechanisms are either activated/enabled or deactivated/disabled as previously described. At a first predetermined volume (first state), the level of fluid 20 in the fluid holding space 18 is at or above the "high" position. At a second predetermined volume (second state), the level of fluid 20 in the fluid holding space 18 can be at zero volume as at start-up of the parts washer, or during operation, between the "low—low" position and the "low" position. At a third predetermined volume (third state), known as the "rinse bank", the level of fluid 20 in the fluid holding space 18 is between the "set point" position and the "high" position. At a fourth predetermined volume (fourth state), the level of fluid 20 in the fluid holding space 18 is between the "low" position and the "set point" position.

The float assembly 60 accounts for a predetermined operation of the parts washer in the four different states therefor. In the first state, an overfill condition can be detected so that fluid operating mechanisms, i.e., the water-fill supply line 92 and rinse manifold 42 which increase the volume of fluid 20 in the fluid holding space 18, are deactivated. In the second state, the float assembly 60 can sense dangerously low fluid conditions during operation of the parts washer and thereby disable those mechanisms which tend to dissipate fluid 20 in the fluid holding space 18, i.e., the heat source 24 and the pump system 30, thereby protecting the pump inlets 112, 114 and rinse heat exchanger 56 as previously described.

Third and fourth predetermined volumes are also isolated. When the float assembly 60 senses that the level of fluid 20 in the fluid holding space 18 is in the third predetermined volume (third state) or the "rinse bank", the float assembly 60 allows all the cleaning mechanisms, i.e., the pump system 30 for the wash cycle and the rinse manifold 42 for the rinse cycle, and the heat source 24 to operate, but deactivates the water-fill supply line 92. In this manner, longer rinse cycles can be obtained than heretofore possible when the water level worked only to a single "set point." With the float assembly described above, because the water-fill supply line 92 operates to fill the fluid holding space 18 only to the "set point", the provision of a "rinse bank" allows accumulation of rinse water to build up the "rinse bank" past the "set point," thereby providing longer rinse cycles. In other words, when the fluid 20 in the fluid holding space 18 is dissipated due to drag-off when removing parts from the cabinet 10 wash cycle operation utilizing steam exhaust, or simple evaporation as when the parts washer is left with heated fluid in the fluid holding space 18 between cleaning cycles, there is then more space available for the accumulation of additional rinse water resulting in longer available rinse cycle times. Unlike prior systems, the rinse water can now be built up into a "rinse bank" which is over the "set point."

In the fourth state, the float assembly 60 accounts for normal operation of all the fluid control mechanisms. When the parts washer is not in a cleaning cycle, such as through operation of the wash and rinse cycles, the water-fill supply line 92 causes water to fill to the "setpoint."

NPSH Reducing System

Figure 2:
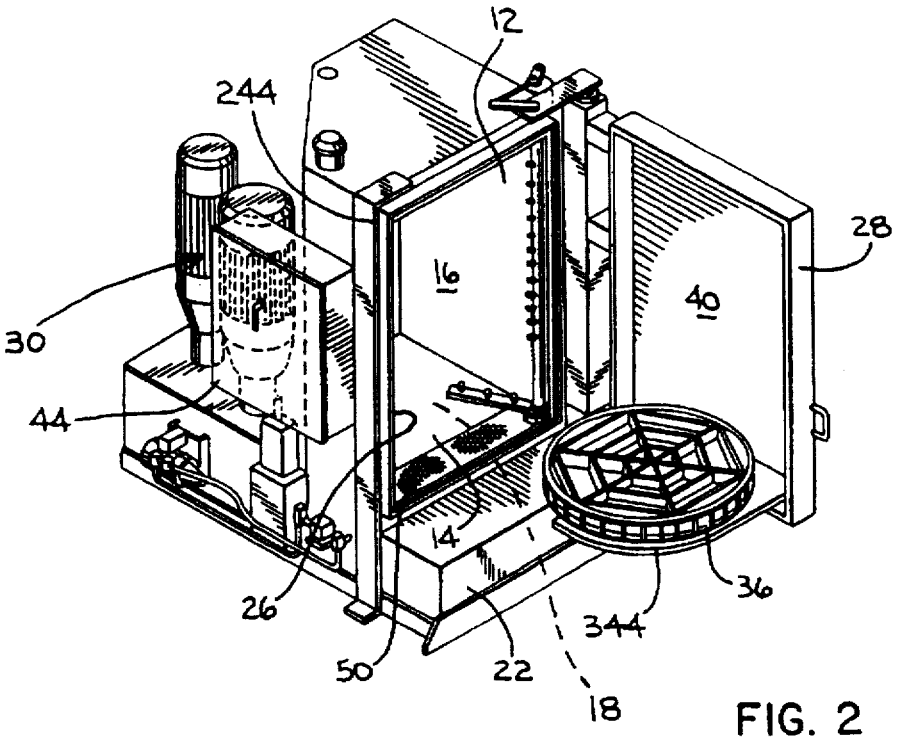
FIG. 2 is a perspective view of the inventive parts washer with an access door having a parts supporting turntable thereon, the door being in an open position.

Referring to FIGS. 2 and 3, means for pressurizing fluid and for delivering pressurized fluid to against a part to be washed is shown in the form of the pump system 30 and the wash manifold 32 and nozzles 34 thereon. The pump system 30 utilizes a main high pressure wash pump 104 and a booster pump 106 each driven by associated motors 108, 110, respectively. The use of the booster pump 106 is optional but further assists in reducing the NPSH (dot Positive Suction Head) required to prevent the heated cleaning fluid 20 from converting to vapor at an inlet 112 to the main pump 104 as more fully described herein. The following description assumes use of a dual-pump system 30 while noting that only the main wash pump 104 may be utilized.

The main pump 104 and the booster pump 106 each have inlets 112 and 114 respectively (FIG. 6) which are located near the bottom of the fluid holding space or reservoir 18 and are therefore normally immersed in cleaning fluid 20. Hence, the fluid pressure head at the pump inlets 112 and 114 will vary as the depth of the fluid 20 in the reservoir 18 changes.

As previously described, means for heating the fluid 20 in the reservoir 18 includes the heat source 24 including the duct 46. The fluid 20 in the reservoir 18 boils at a first temperature which is approximately 212° F. when the fluid 20 is water. The heat source 24 heats the fluid 20 to a temperature near the boiling temperature of the fluid 20 so that the fluid 20 is hot but not boiling.

Because the fluid 20 is near boiling, any reduction in pressure such as at the booster pump inlet 114 can cause boiling, producing undesirable air bubbles at the booster pump inlet 114. This reduction in pressure at the booster pump inlet 114, or at the wash pump inlet 112 when a booster pump 106 is not used, to a pressure at or below the fluid vapor pressure, causes cavitation in the pump system 30 leading to decreased efficiency and/or equipment failure.

To avoid increasing the height of the parts washer to provide the necessary NPSH for operation of the pump system 30 by increasing the fluid pressure head over the fluid vapor pressure at the wash pump inlet 112, means are provided for increasing the fluid pressure at the pump inlet 112 without changing the fluid depth at the inlet 112. This means can take the form of a feed conduit 116 (FIG. 6) used in conjunction with the previously described booster pump 106 in a dual-pump system 30 or just the feed conduit 116 when a booster pump 106 is not used. When the booster pump 106 is not employed, the feed conduit 116 is used with the main wash pump 104 in a similar fashion to its use with the booster pump 106 described below.

Figure 6:
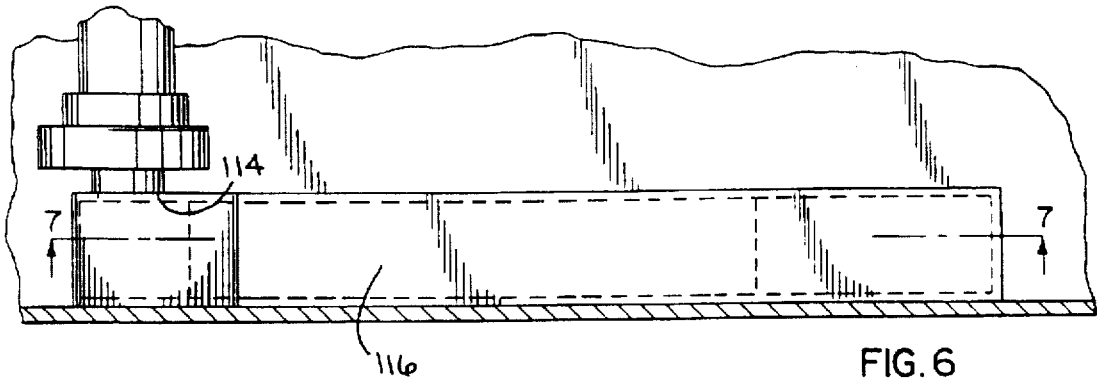
FIG. 6 is an enlarged side elevation view of a feed conduit and a portion of a booster pump for delivering heated washing fluid to a wash manifold.
Figure 7:
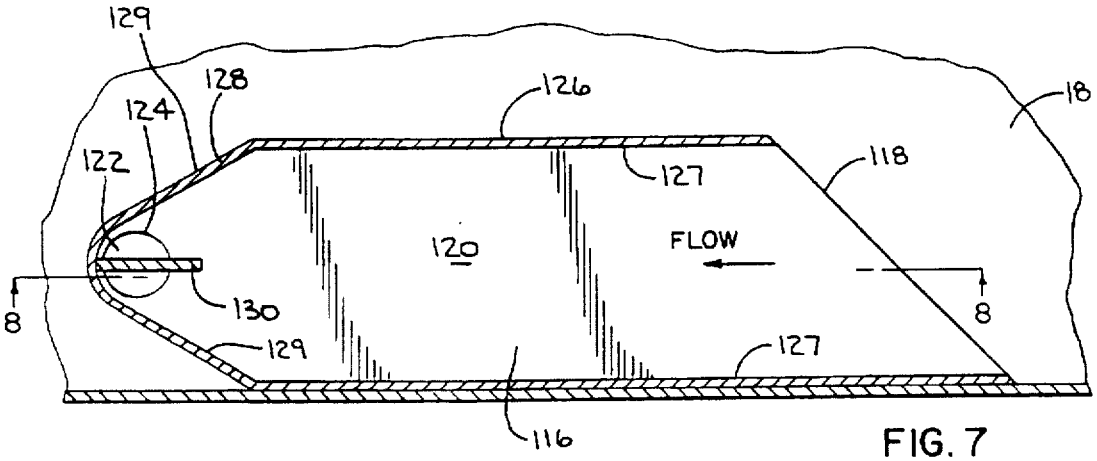
FIG. 7 is a cross-sectional view of the feed conduit taken along line 7—7 in FIG. 6, illustrating a neck-down section, an outlet and a plate of the feed conduit.
Figure 8:
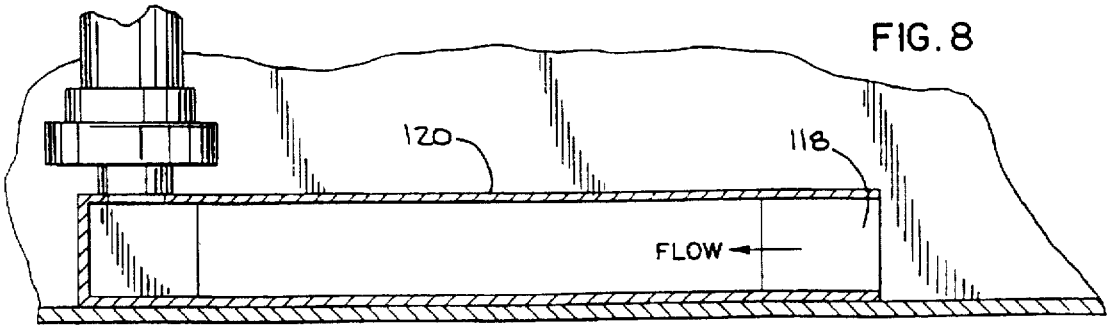
FIG. 8 is a cross-sectional view of the feed conduit taken along line 8—8 in FIG. 7 generally illustrating the direction of flow through the feed conduit.

FIGS. 6–8 more clearly show the construction of the feed conduit 116 which can be used in conjunction with the booster pump 106 to reduce the NPSH required for the pump system 30.

The feed conduit 116 has an inlet 118 for fluid 20 from the reservoir 18. The feed conduit 116, and specifically the inlet 118 therefor extends into a filter box 119 located in the access reservoir 22. (FIGS. 23 and 24) The feed conduit 116 includes an upper wall 120 defining a hole 122 which acts as an outlet 124 for fluid 20 travelling through the conduit 116 to the booster pump inlet 114.

The feed conduit 116 has a neck-section 126 leading to a neck-down section 128 which further leads to the conduit outlet 124. The neck section 126 includes parallel side walls 127. The neck-down section 128 includes side walls 129 which taper towards each other and meet near the outlet 124. The parallel side walls 127 and the tapering side walls 129 are connected to the upper wall 120. The walls 120, 127 and 129 all can be formed integrally with each other. The booster pump 106 is mounted on the upper wall 120 of the feed conduit 116 so that the booster pump inlet 114 is in communication with the feed conduit outlet 124. Fluid 20 from the reservoir 18 enters the feed conduit inlet 118 due to suction forces created by operation of the pump system 30 and develops a velocity momentum head in the tube neck-section 126. The neck-down section 128 increases the velocity in the conduit 116 thereby increasing the velocity head of the fluid 20 as it approaches and leaves the conduit outlet 124 and enters the booster pump inlet 114. The booster pump 106 can then provide fluid 20 to the inlet 112 of the main wash pump 104 at a pressure greater than the vapor pressure of fluid 20 at the wash pump inlet 112 allowing high-speed operation of the wash pump 104 without fear of cavitation caused by suction forces at the inlet 112 thereof.

The construction of the conduit 116 in conjunction with the suction forces generated by the pump system 30 can tend to cause vortex flow near the conduit outlet 124 and booster pump inlet 114. Means are provided to prevent the conduit 116 from creating such vortex flow in the form of a plate 130 positioned in the conduit 116 near the outlet 124 thereof, as best seen in FIG. 7. The plate 130 is positioned such that any vortex flow that forms near the conduit outlet 124 is disrupted and thereby eliminated before exiting the conduit 116. This further assists in eliminating cavitation in the pump system 30. More specifically, the plate 130 extends upwardly towards the conduit outlet 124 between the side walls 129 and is perpendicular to the upper wall 120. Any vortex which forms in the conduit 116 will have its central axis extending through the center of the hole 122 which will be perpendicular to the upper wall 120. Hence, by utilizing the plate 130 which extends in the same general direction as the central axis of potential vortex flow in the conduit 116, such vortex flow is eliminated.

The use of the feed conduit 116 in conjunction with the booster pump 106 enables the fluid 20 used for the wash cycle to be kept at near its boiling point at lower fluid depths without converting to vapor at the inlet 112 of the main wash pump 104. The use of a booster pump 106 further assists in maintaining the fluid 20 at a high temperature while allowing high speed operation of the main high pressure wash pump 104. The high temperature fluid 20 is desirable as it provides for more effective cleaning of parts to be washed.

Cabinet Sealing System

Figure 9:
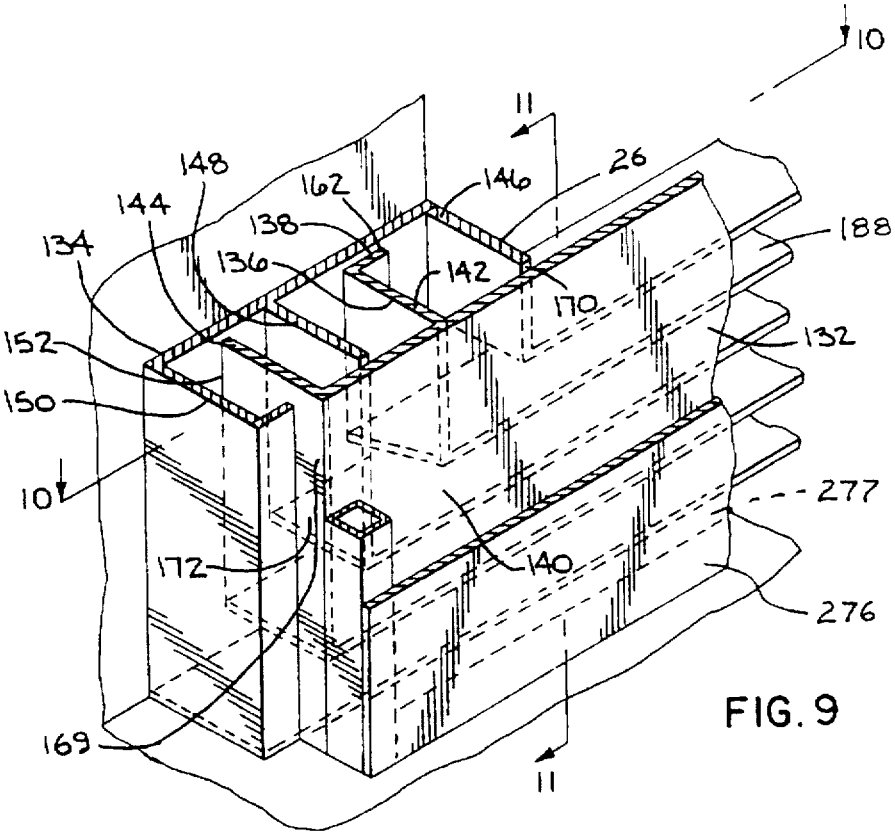
FIG. 9 is an enlarged, perspective view of a door and a frame that can be used with the inventive parts washer in section.
Figure 10:
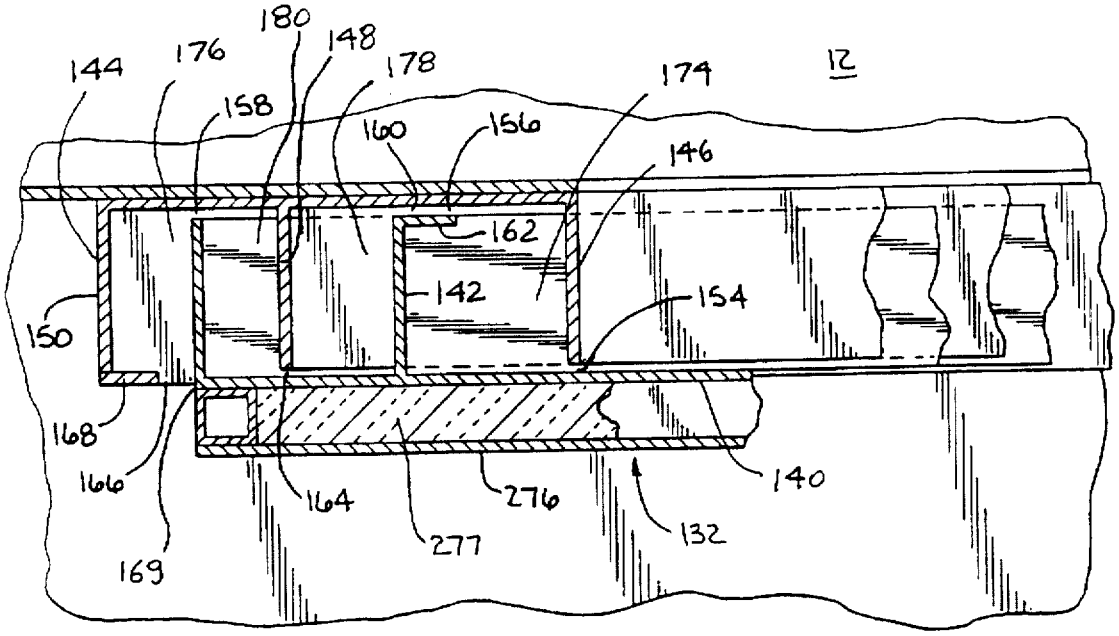
FIG. 10 is a cross-sectional view of the door and the frame taken along line 10—10 in FIG. 9.
Figure 11:
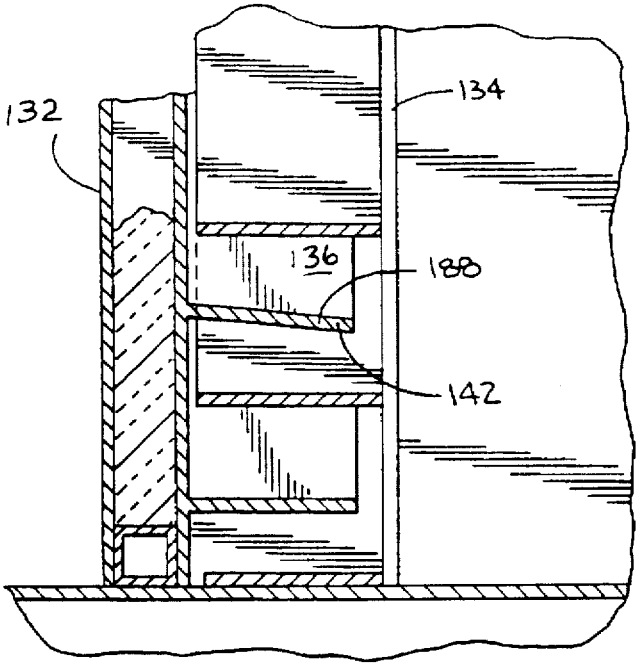
FIG. 11 is a cross-sectional view of the door and the frame taken along line 11—11 in FIG. 9.

Referring now to FIGS. 9–11, a novel door 132 and frame 134 combination for the cabinet opening 26 is illustrated. The door or closure element 132 is mounted to the cabinet 10 generally above the fluid holding space 18, as shown in FIG. 2. The cabinet opening 26 provides access to the internal or interior space 12 of the cabinet 10 when the door 132 is open. When the door 132 is closed with parts in the washing chamber 16 to be washed, the door 132 effectively seals the opening 26 during the cleaning cycle so that less energy is required to keep the fluid 20 heated in the fluid holding space 18. An effective seal also allows the amount of steam or vapor exhausted from the cabinet 10 by the steam exhaust 52 to be accurately controlled which assists operation of the fluid level control system previously described.

The door 132 includes means thereon for cooperating with the cabinet 10 to define a controlled flow path for a pressurized fluid such as cleaning fluid/liquid 20 or vapor entrained during the cleaning cycle in the cabinet interior space 12 during the cleaning cycle. The cooperating means includes at least one flange 136 on either the door 132 or the cabinet 10 which causes the liquid 20 or vapor to change direction as it traverses the controlled flow path thereby at least partially preventing escape of the liquid 20 or vapor from the cabinet 10. The flange 136 can include a transverse leg 138 attached thereto which intercepts the flow of either liquid 20 or vapor traversing the controlled flow path thereby creating eddies of flow in the controlled flow path such as are characteristic of turbulent flow. The use of the transverse leg 138 on the flange 136 further ensures that only negligible amounts of liquid 20 and vapor can escape from the cabinet.

Preferably both the door 132 and the cabinet 10 are provided with multiple flanges 136 which cooperate to define at least a portion of the controlled flow path. Referring to FIG. 9, the door 132 is provided with a border area 140 which has an inner flange 142 and an outer flange 144 attached thereto. The cabinet 10 has a frame 134 mounted to the cabinet 10 around the opening 26 thereof. The frame 134 has three flanges, an inner flange 146, a middle flange 148 and an outer flange 150 extending towards the exterior of the cabinet 10 such that when the door 132 is closed, the door border area 140 will be facing the cabinet frame 134.

In the closed position, the door inner and outer flanges 142 and 144 will extend towards the cabinet frame 134 and will be spaced therefrom, and the cabinet frame flanges 146, 148 and 150 will extend towards the door border area 140 and will be spaced therefrom. Generally, when the door 132 is closed, the spacing is close enough between the flanges 136 and border area 140 or frame 134 such that liquid 20 in the internal space 12 that gets into the controlled flow path will at least partially seal the spaces through the surface tension forces of the liquid which tend to create a capillary action between the flanges 136 and one of the door border area 140 and the frame 134. This capillary action will substantially block passage of vapor through the controlled flow path as generally the vapor pressure generated in the cabinet 10 during the cleaning cycle will not be sufficient to overcome this capillary force. Also, vapor contacting the surfaces 152 of the flanges 136 in the controlled flow path will tend to condense on the surfaces 152 with such condensate also adding to the liquid 20 which helps produce the previously-described seal.

As best seen in FIG. 10, the spaces include a first space 154 formed by the frame inner flange 146 and the door border area 140 with the first space 154 being proximate the interior space 12. Second and fourth spaces 156 and 158 respectively, are formed in the controlled flow path by door inner and outer flanges 142 and 144, respectively, and the frame 134. The second space 156 defines a channel 160 due to the provision of a transverse leg 162 on the door inner flange 142 the leg 162 extending generally parallel to the frame 134. A third space 164 is formed in the controlled flow path by the middle frame flange 148 and the door border area 140. A fifth space 166 is defined by a transverse leg 168 of the outer frame flange 150 and an outer edge 169 of the door 132. The spaces progress sequentially from the first space 154 proximate to the interior space 12 to the fifth space 166 distal from the interior space 12 with the first and fifth spaces 154 and 166 being the inlet 170 and outlet 172 for the controlled flow path.

Likewise, the flanges 136, the frame 134 and the door border area 140 cooperate to define a series of chambers which, similar to the spaces, progress from a first chamber 174 proximate the internal space 12 to a fourth chamber 176 distal from the interior space 12. The first chamber 174 is in communication with the interior space 12 through the first space 154 and is in communication with a second chamber 178 through the second space 156. The second chamber 178 can communicate with a third chamber 180 through the third space 164 and the third chamber 180 communicates with the fourth chamber 196 through the fourth space 158. Finally, the fourth chamber 176 can communicate with the exterior of the cabinet 10 through the fifth space 166. Thus, the provision of the chambers creates an extensive labyrinth controlled flow path through which liquid 20 and vapor must travel before reaching the exterior of the cabinet 10. Thus, any liquid 20 or vapor that flows through the first chamber 174 will have to overcome the capillary forces present in the first and second spaces first and second spaces 154 and 156. Even if some liquid 20 or vapor escapes the first chamber 174 and progresses to the second chamber 178, the liquid 20 or vapor will tend to be sealed in the second chamber 178 as the liquid 20 or vapor contacts the surfaces 152 in the second chamber 178 and loses the energy and therefore the pressure, required to overcome the capillary forces existing at the third space 164. Likewise, the provision of third and fourth chambers 180 and 176, respectively, will further decrease the likelihood of any significant amount of liquid 20 or vapor escaping from the cabinet 10. Fluid 20 that has progressed through the controlled flow path to the fourth chamber 176 will most likely be in liquid form and as such will tend to flow down into the fluid holding space 18.

The door 132 has a top section 184 and a bottom section 186 (FIGS. 9–11 and 22). Normally, the flanges 136 are all attached to the frame 134 and the door border area 140 to be at right angles to the vertical extent of frame 134 and the door border area 140. However, at the top and bottom sections 184 and 186, the door inner flange 142 has a surface 188 which is connected to the door border area 140 such that the surface 180 is angled downwardly towards the reservoir 18, as seen in FIG. 11. This orientation of the door inner flange surface 188 at the door top and bottom sections 184 and 186 allows the force of gravity to direct any liquid accumulated on the surface 188 towards the interior 12 of the cabinet 10.

The door 132 and frame 134 and their associated flanges 136 can be made from any metallic-type or non-resilient material, such as steel, and through the use of a controlled flow path which causes liquid 20 or vapor to change directions as it traverses the controlled flow path, provide an effective seal which can be obtained without use of elastomeric gaskets and contacting parts subject to wear. Furthermore, the previously described spaces defined in the controlled flow path provide the fabricator greater manufacturing tolerances than available with those doors using contacting parts and compression seals.

Oscillating Tumbler Manifold System

Figure 12:
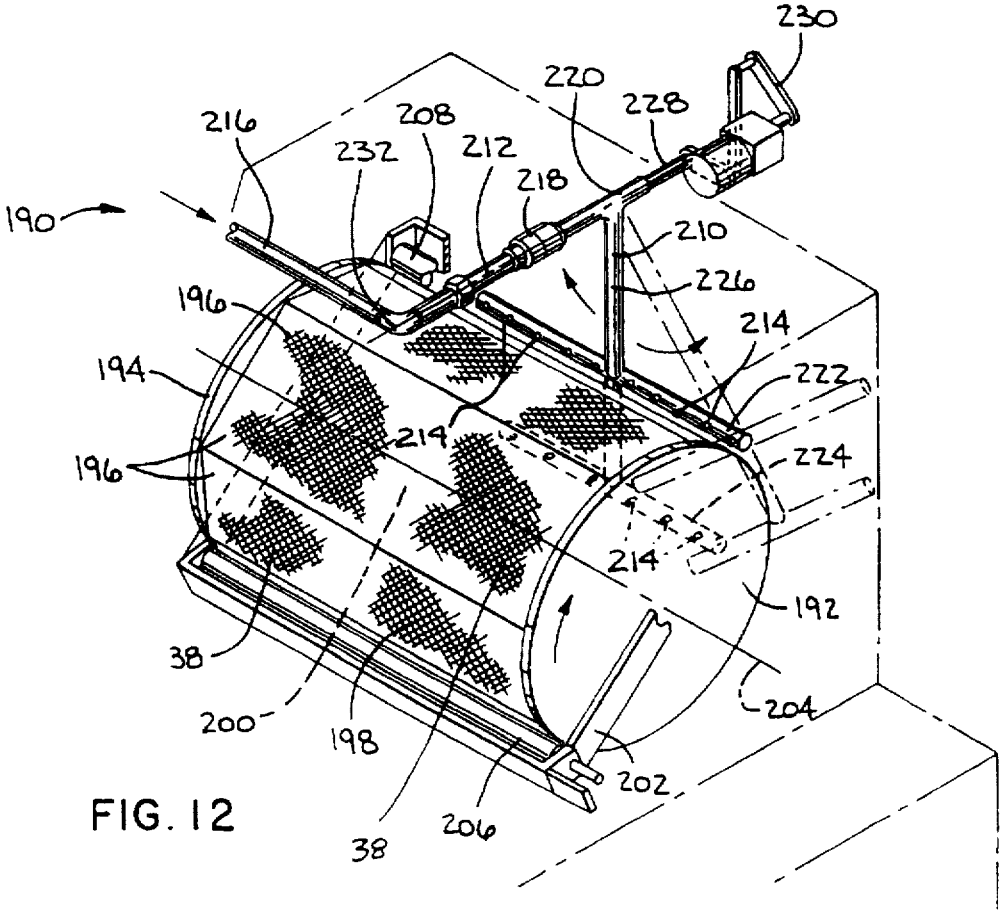
FIG. 12 is an enlarged perspective view of a tumbler and a wash manifold with a structure for oscillating the manifold that can be used with the inventive parts washer.

FIG. 12 illustrates the oscillating tumbler manifold system 190. The oscillating tumbler manifold system 190 includes means for supporting parts to be washed which preferably is in the form of the tumbler 38. The tumbler 38 generally has a cylindrical shape including two circular end plates 192 and 194. Extending between the plates 192 and 194, are a plurality of generally flat lattice sections 196 having holes 198 therein. The plates 192 and 194 and the lattice sections 196 define a chamber 200 for containing parts to be washed. The holes 198 are of sufficient size so that cleaning fluid 20 directed against the tumbler 38 can wash the parts in the chamber 200.

The tumbler 38 is mounted to a structure 202 which can be connected to the door 28 of the parts washer such that when the door 28 is open, the tumbler 38 is exterior of the cabinet 10 and when the door 28 is dosed, the tumbler 38 is in the washing chamber 16.

The tumbler 38 is supported by the support structure 202 such that the tumbler 38 can be rotated about a first axis 204 by a drive means (not shown) connected to rollers 206 and 208. The first axis 204 extends through the centers of the circular end plates 192 and 194.

Means are provided for delivering cleaning fluid 20 from a pressurized supply to against a part in the chamber 200 of the tumbler 38 in the form of the previously described pump system 30 in conjunction with a modified wash manifold 210. The modified wash manifold 210 consists of a conduit 212 which receives pressurized fluid 20 from the pump system 30 with the conduit 212 including fluid directing means in the form of nozzles 214 on the conduit 212. The nozzles 214 direct pressurized cleaning fluid 20 in a discharge direction that is transverse to the first axis 204.

The conduit 212 has a fixed first section 216 which extends transversely to the first axis 204 and is rotatively coupled, as by a swivel 218, to a second section 220 which forms a T-shaped frame to support horizontal tubes 222 and 224 thereon. The second section 220 has a vertical tube 226 forming the central leg of the "T". Both horizontal tubes 222 and 224 have the nozzles 214 mounted thereon which are in fluid communication with the conduit 212. The second section 220 also includes a portion 228 of the upper crossbar of the "T" which extends through the cabinet 10 to a drive means 230 for causing rotation of the second section 220 about a second axis 232 transverse to the first axis 204.

As the second section 220 is rotated about the second axis 232, the nozzles 214 mounted on the upper and lower horizontal tubes 222 and 224 are repositioned with respect to the tumbler 38 thus providing a greater variety of positions from which the nozzles 214 can direct cleaning fluid 20 against the tumbler lattice sections 196, and thus parts in the tumbler chamber 200. The drive means 230 operates to rotate the second section 220 reciprocatively so that the vertical tube 226 along with the horizontal tubes 222 and 224 and their associated nozzles 214 oscillate along the length of the tumbler 38. In this manner, the lower horizontal tube 224 can have a length which is less than the length of the upper horizontal tube 222 with the nozzles 214 thereon still providing fluid coverage to the entire envelope of the tumbler 38 from one end plate 192 to the other 194, as shown in the ghost position illustrated in FIG. 12. Likewise, by oscillating the manifold 210, the nozzle spray angle can be reduced so that the angle no longer need be such as to provide coverage to the entire tumbler envelope from a stationary position. Hence, the reduced spray angle can be such that the fluid 20 exiting the nozzles 214 can be either in a thin stream or a thin spray of fluid as described below.

Figure 13A:
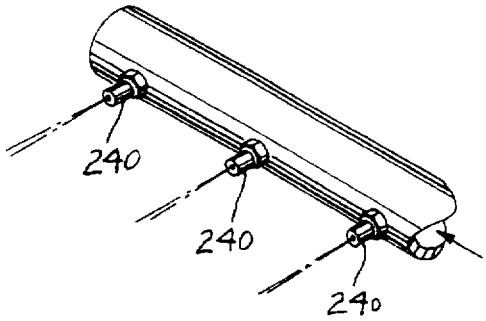
FIG. 13A is a perspective view of nozzles having a 0° spray angle mounted on a horizontal tube of the oscillating wash manifold.
Figure 13B:
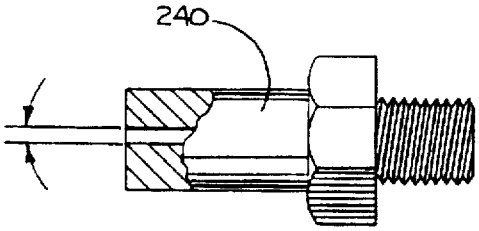
FIG. 13B is an enlarged side elevation view partially in section of the 0° nozzle.
Figure 14A:
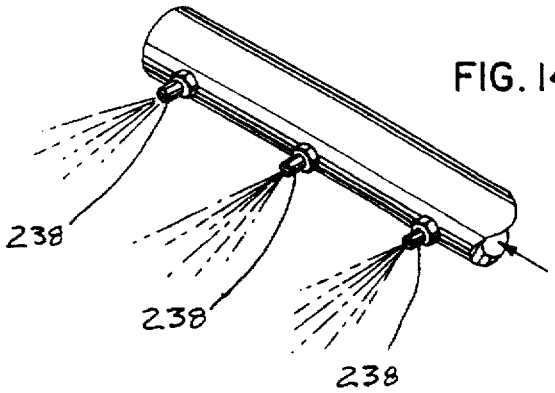
FIG. 14A is an enlarged perspective view of nozzles having a 15° spray angle mounted on a horizontal tube.
Figure 14B:
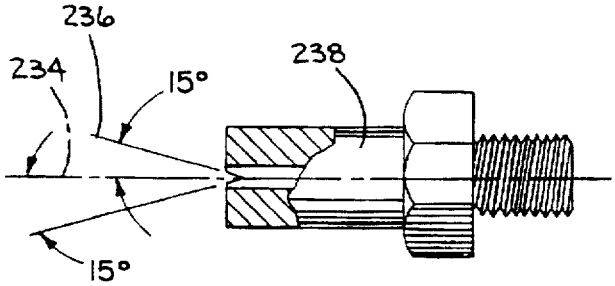
FIG. 14B is an enlarged side elevation view partially in section of the 15° nozzle.
Figure 21:
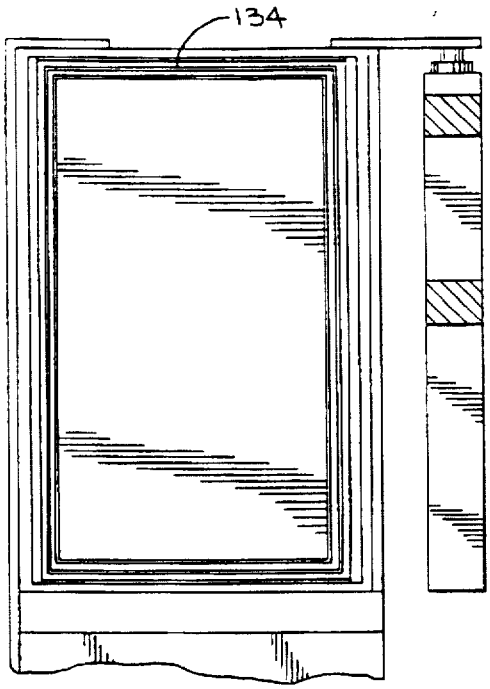
FIG. 21 is an enlarged front elevation view partially in section of the frame for the door which can be used with the inventive parts washer.

The nozzle spray angle is defined as the angle between an axis 234 of the nozzle and an outer edge 236 of the spray as illustrated in FIG. 14B wherein the angle is shown to be 15°. Because the wash manifold 210 is oscillating about the second axis 232 perpendicular to the first axis 204, the nozzles 214 used on the upper horizontal tube 222 can be reduced to 15° nozzles 238 which discharge a thin spray of fluid therefrom as shown in FIG. 14A, while the nozzles 214 on the lower horizontal tube 224 can be reduced even further to 0° nozzles 240 which discharge a thin stream of fluid therefrom as shown in FIG. 13A, and still cover the entire envelope of the tumbler 38. These reduced angle spray nozzles direct cleaning fluid 20 at parts with greater impact pressure over larger angled nozzles used with stationary manifolds resulting in more effective part cleaning.

Temperature/Pressure Equalization System

Figure 24:
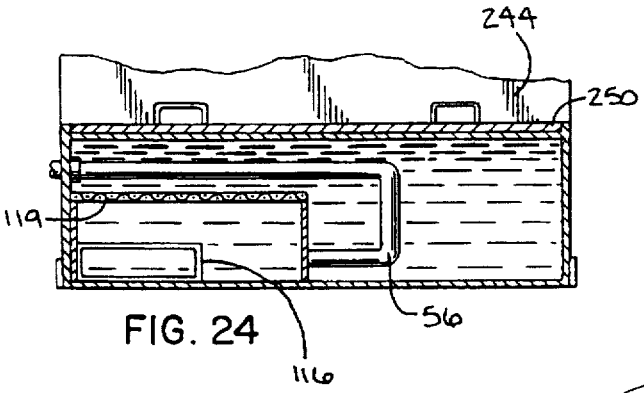
FIG. 24 is a cross-sectional view of the access filter reservoir showing the feed conduit, a rinse heat exchanger and the removable cover for the access reservoir taken along line 24—24 in FIG. 23.
Figure 23:
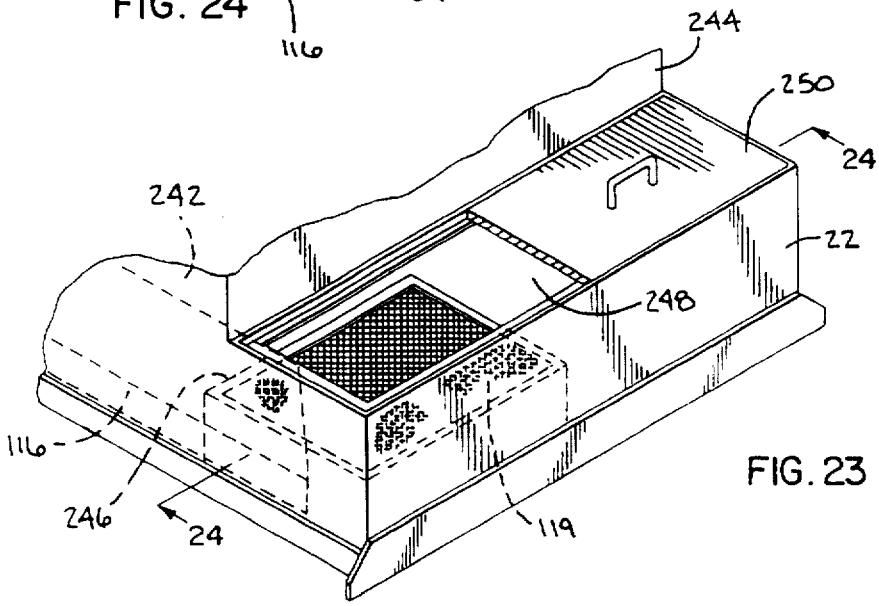
FIG. 23 is an enlarged perspective view of the access reservoir of the inventive parts washer with a cover of the access reservoir in section and illustrating a filter box and a feed conduit broken lines.

Referring to FIGS. 3, 23, and 24 the cabinet 10 is shown in outline form for a view of various components of the parts washer, including the temperature/pressure equalization system.

As previously described, the internal space 12 of the cabinet is divided by the false floor 14 into the parts washing chamber 16 and a portion of the fluid holding space 18, designated as an internal fluid holding space 242, as seen in FIG. 23. The remaining portion of the fluid holding space 18 is exterior of the internal space in the form of the access reservoir 22. The cabinet 10 has a wall 244 which defines the opening 26 for the door 28 and a second opening 246 leading to the access reservoir 22. The access reservoir 22 has a top opening 248 through which cleaning agents can be added to cleaning fluid 20 and various other servicing tasks can be performed as necessary on the parts washer. The access reservoir top opening 248 can be closed by a removable cover 250.

The internal space 12 of the cabinet 10 contains a first fluid and a second fluid. The second fluid is an incompressible fluid, such as the cleaning fluid 20 in the fluid holding space 18, while the first fluid is a compressible fluid, such as air.

The internal fluid holding space 242 contains a first means for heating the cleaning fluid in the form of the heat source 24 which is submerged in cleaning fluid 20. (FIG. 3) The heat source 24 heats the cleaning fluid 20 so that it is at a raised temperature versus the air in the internal space 12 before the cleaning cycle begins. The false floor 14 also contributes to the temperature differential between the air and heated cleaning fluid 20 by insulating the heated cleaning fluid 20 in the fluid holding space 18 from the air that occupies the washing chamber 16.

Second means are provided for directing heated cleaning fluid 20 from the fluid holding space 18 to against parts in the washing chamber 16 which can take the form of the previously described pump system 30 and wash manifold 32. The pump system 30 includes the high pressure, high speed wash pump 104 which supplies pressurized heated cleaning fluid 20 to the wash manifold 32. The wash pump 104 can supply fluid 20 to the wash manifold 32 at a pressure of approximately 200 p.s.i. and at a rate of approximately 350 gallons per minute. The wash pump 104 can be rated as high as 400 p.s.i. and 550 gallons per minute.

Once the cleaning cycle is initiated, the wash pump 104 begins to operate so that an initial burst of heated cleaning fluid 20 discharged into the internal space 12 from the nozzles 34 of the wash manifold 32 causing a sudden increase in the temperature of the relatively cool air in the internal space 12. This temperature increase causes a rapid expansion of the air in the internal space 12 thereby producing a water-hammer effect in the cabinet by creating pressure waves in the cleaning fluid 20 which may force cleaning fluid 20 out of the second opening 246 leading to the access reservoir 22 and into the access reservoir 22 which generally will be substantially filled with cleaning fluid 20 already. This water-hammer effect can potentially be damaging to equipment in the cabinet 10, or to the cabinet 10 itself. Likewise, the force with which the expanded air expels cleaning fluid 20 into the access reservoir 22 can be great enough to cause a significant volume of cleaning fluid, in the range of about 25 to 50 gallons, to burst out of the access reservoir 22 even with the removable cover 250 thereon. This water-hammer effect is great enough to lift the removable cover 250, which is generally a thick steel cover and can weigh approximately 45 pounds, so that a large volume of cleaning fluid 20 is discharged from the parts washer.

To avoid the above-described water-hammer effect, third means is provided to gradually increase the temperature of the air before the cleaning cycle begins so that operation of the wash cycle does not cause sudden expansion of air in the internal space 12 of the cabinet 10 as might cause pressure waves to form in the cabinet 10 and/or as might cause expulsion of cleaning fluid 20 through the second opening 246. The gradual increase in the temperature of the air produces a slow expansion of the air in the internal space 12 of the cabinet 10 so that any corresponding increase in pressure can bleed off slowly from the cabinet 10 thereby avoiding any sudden expansion of air and the water-hammer effect previously described at start-up of the cleaning cycle.

The third means can take the form of a nozzle 252, as shown in FIG. 15, which has a supply line 254 that extends through the cabinet 10 into the fluid holding space 18. The nozzle 252 is positioned in the fluid holding space 18 so that at startup, the nozzle 252 is submerged in cleaning fluid 20.

The supply line 254 is connected to a source of compressed air 256, as seen in FIG. 3. Prior to starting the wash pump 104, the air in the internal space 12 can be preheated for a pre-selected time period by activating the compressed air source 256 so that compressed air is discharged from the nozzle 252 through the heated cleaning fluid 20 thereby entraining a spray of heated cleaning fluid 20 in the internal space 12 which will raise the temperature of the air in the internal space 12 to a temperature close to that of the heated fluid 20. The nozzle 252 can be a venturi-type nozzle 258 used with a diffuser 260 which directs the atomized heated fluid spray from the nozzle 258 into the internal space 12 of the cabinet 10, as illustrated in FIG. 15.

The preheating of air can also be accomplished in a dual-pump system 30 by preactivating the low pressure booster pump 106 before the main wash pump 104 is started. In this manner, heated fluid 20 can also be entrained in the internal space 12 to heat the air to a temperature near that of the heated fluid 20.

Preheating the air in the internal space 12 allows for safe startup operation of the parts washer such that the danger of creating a pressure wave in the heated cleaning fluid 20 at startup of the wash cycle which creates a potentially damaging water-hammer effect in the cabinet 10 and/or creates a wave of heated fluid 20 that forces the access reservoir cover 250 open and thereby expels a large quantity of cleaning fluid 20 from the parts washer onto the surrounding floor is eliminated.

Reduced Footprint Parts Washer

A parts washer having a reduced footprint is illustrated in FIGS. 18 and 19. The reduced footprint parts washer, designated generally 262, has a front side 264, a back side 266, a top side 268, a bottom side 270, and laterally spaced sides 272 and 274.

Unlike the parts washer shown in FIG. 1, the front side 264 and the laterally spaced sides 272 and 274 are free from mechanisms that require servicing such as the pump motors 108 and 110, the fresh water pump 100 and the various fluid supply lines and valves for the fresh water supply system. In the reduced footprint parts washer 262, these mechanisms have all been moved so that they are mounted to the top side 268 and the back side 266.

In addition, the control box 44, which houses the means for automatically controlling the above-described mechanisms which operate during a cleaning cycle has been incorporated into the door 28, through the provision of an insulating skin 276 on the door 28. The insulating skin 276 is illustrated in FIGS. 9 and 10 with a door 132 of the previously described cabinet sealing system. The insulating skin 276 defines a chamber 277 which includes the control box 44. The control means can be in the form of any known automated electrical controls which allow for operation of the parts washer operating mechanisms.

The location of the operating mechanisms at the top 268 and the back 266 of the reduced footprint parts washer 262 allows the laterally spaced sides 272 and 274 each to extend in a continuous, flat surface from the top edge 278 of the laterally spaced sides 272 and 274 to the bottom edge 280 thereof without anything being mounted thereto. In addition, significant space savings are realized by the reduced footprint parts washer 262 over prior pans washers in that, unlike prior pans washers, the space between the lateral sides 272 and 274 is less than the parts washer depth which is the space between the front side 264 and back side 266 of the reduced footprint parts washer 262.

Preferably, the reduced footprint pans washer 262 has a lower base section 282 and an upper wash section 284 which does not extend as far to the back as the lower base section 282 so that the lower base section 282 defines a back ledge 286 for an additional surface to which the operating mechanisms can be mounted.

To further facilitate the space savings realized by the reduced footprint parts washer 262, other unique modifications to the parts washer have been incorporated into the design of the reduced footprint parts washer 262.

Referring now to FIGS. 19 and 20, the access reservoir lo and the filter box 119 located therein and the perforate section 50 of the false floor 14 have been replaced with a removable filter basket 288 positioned in the false floor 14 and a settling chamber 290 of the fluid holding space 18 beneath the filter basket 288 which is substantially isolated from the remainder of the fluid holding space 18 for a purpose to be described herein. A from comer section of the false floor 14 has been removed with the filter basket 288 being placed therethrough so that cleaning fluid 20 and rinse water are filtered after being directed at the parts to be washed but before returning to the fluid holding space 18. The settling chamber 290 below the filter basket 288 is substantially isolated from the remainder of the fluid holding space 18 and provides additional insurance against debris and sludge making its way to the pump system 30. The settling chamber 290 includes a first wall 292 and a second wall 294 extending upward towards the false floor 14. The first and second walls 292 and 294 are adjoining and can be at right angles to each other. The first and second walls 292 and 294 are further configured so that they cooperate with the front side 264 and one of the laterally spaced sides 272 and 274 and the filter basket 288 to define the settling chamber 290. One of the first and second walls 292 and 294 does not extend all the way to the false floor 14 while the other does.

Preferably the first wall 292 which is in contact with the from side 264 does not extend all the way to the false floor 14 thereby creating a slot 296 through which filtered fluid 20 communicates with the remainder of the fluid holding space 18. By such a construction, any sludge or debris which is not filtered by the filter basket 288 will settle to the bottom 298 of the isolated settling chamber 290 and can be removed therefrom after the cleaning cycle is completed through a clean-out port 300. In addition, the provision of the removable filter basket 288 towards the front of the cabinet 10 allows for easier cleaning than previously possible.

The feed conduit 116 of the previously described NPSH reducing system can be used in a modified form. A modified feed conduit 302 is employed so as to reduce space requirements in the fluid holding space 18. The modified feed conduit 302 is designed so that the neck section 126, present in the conduit 116 as shown in FIG. 7 is removed and only the neck-down section 128 remains, as seen in FIG. 19.

The rinse heat exchanger 56 has also been modified so that it reduces vertical space requirements as it is now in the form of a box-like structure 304, as seen in FIG. 19. The box-like modified heat exchanger 304 also provides additional advantages as it generally has approximately three-times the volume of the conventional heat-exchanger 56 so that the water therein has great residence time in the heat exchanger 304 thereby allowing more heat from the heated cleaning fluid 20 in the fluid holding space 18 to be transferred thereto.

The turntable 36 has been repositioned so that it is no longer mounted to the door 28 and instead is installed in the wash chamber 16. By virtue of the location of the turntable 36 in the wash chamber 16, the unsightly flanges 306 (FIG. 1) attached to the outside surface 308 of the door 28 of a conventional size parts washer can be removed so that when the door 310 on the reduced footprint parts washer 262 is closed it will cooperate with the front side 264 of the cabinet 10 to create a substantially flat continuous surface 312 extending from a top front laterally extending edge 314 to a bottom front laterally extending edge 316 of the reduced footprint parts washer 262.

Fold-Up Turntable

Means for supporting parts to be washed having a first configuration during a washing operation in the form of a fold-up turntable, designated 318, is illustrated in FIGS. 16 and 17, and has generally a circular shape during a washing operation or cleaning cycle.

The fold-up turntable 318 has particular usefulness in the previously-described reduced footprint parts washer 262 wherein it is mounted in the internal space 12 of the cabinet 10. The fold-up turntable can also be used with a conventional sized parts washer wherein the fold-up turntable can be either mounted to the door 28 or mounted in the internal space 12 of the cabinet 10.

The fold-up turntable 318 includes means for providing ready access to areas around the turntable in the form of a first flange 320 extending from a pivotable section 322 of the fold-up turntable 318 and a second flange 324 extending from a non-pivotable section 326 of the fold-up turntable 318. The first flange 320 is releasably fastenable to the second flange 324 such that when the first flange 320 is fastened to the second flange 324, the fold-up turntable 318 is in a non-pivoted position and has a circular shape, as shown in solid lines in FIG. 17. A pivoted position is illustrated in ghost in FIG. 17 showing the first flange 320 detached from the second flange 324 to provide ready access to areas around the turntable 318 for easier cleaning of these previously difficult to access areas.

To fasten the pivotable section 322 to the non-pivotable section 326 cooperating bosses having holes for receipt of a bolt 328 therethrough are provided. The pivotable section 322 has a boss 330 on the first flange 320 and the non-pivotable section 326 has an upper boss 332 and a lower boss 334 on the second flange 324 such that when the turntable 318 is in its non-pivoted position, the boss 330 of the pivotable section 322 is sandwiched by the upper boss 332 and lower boss 334 of the non-pivotable section 326 with their respective holes in vertical alignment with each other. The bolt 328 can be inserted through the holes in the bosses 330, 332, and 334 to thus releasable fasten the turntable sections 322 and 326 to each other.

Both sections 322 and 326 of the turntable 318 are made up of a plurality of pie-shaped pieces 336 which have several interconnected flanges 338 forming a lattice-type structure, as seen in FIG. 16. This allows cleaning fluid 20 to contact the parts from above the turntable 318 and to drip through the turntable 318 and back to the fluid holding space 18 as well as allowing cleaning fluid 20 to be directed through the bottom of the turntable 318 to dean the underside of parts supported thereon.

The fold-up turntable 318 includes means for rotatively mounting the fold-up turntable 318 to a vertically extending column 340, illustrated in FIG. 17. The second flange 324 has a cylindrical shape and defines an annular bore 342 therein such that the column 340, which can either be mounted in the cabinet internal space 12 or to a rigid arm (not shown) mounted to the door 28, can extend into the annular bore 342. This allows the fold-up turntable 318 to rotate about the column 340 as by drive means for rotation of the turntable (not shown) during a cleaning cycle when the turntable 318 is in the non-pivoted position, or by manually rotating the turntable 318 after completing a cleaning cycle when the turntable 318 is pivoted allowing ready access to areas around the turntable 318 for easy cleaning thereof.

When the fold-up turntable 318 is used in the reduced footprint parts washer 262 or the conventional sized parts washer where it is mounted in the interior space 12, the fold-up turntable 318 is positioned just above the false floor 14 so that after a cleaning cycle is completed, the fold-up turntable 318 can be pivoted, as seen in FIG. 17, and rotated so that all areas beneath the fold-up turntable 318, such as the false floor 14 and the perforate section 50 thereof in a conventional sized parts washer and the false floor 14, the removable basket 288 and the settling chamber 290 in a reduced footprint parts washer 262, can be easily accessed for cleaning.

Figure 22:
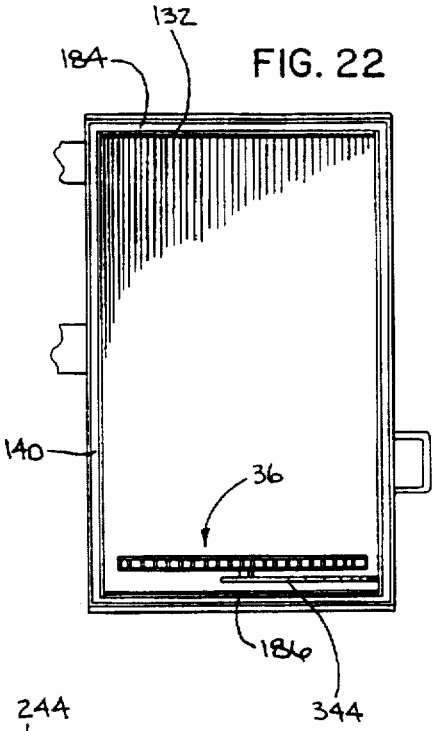
FIG. 22 is an enlarged rear elevation view of the door which can be used with the inventive parts washer.

When a turntable, and specifically a fold-up turntable 318, is used mounted to the door 28 in a conventional sized parts washer, a turntable drip pan 344 is mounted to the door 28 just beneath the turntable, as seen in FIG. 22. The drip pan 344 underlies approximately one-half of the area of the turntable 318 so as not to interfere with any cleaning fluid 20 from the wash manifold 32 that is directed upwardly through the turntable 318 during the cleaning cycle. When the door 28 is open, the drip pan 344 prevents cleaning fluid 20 from dripping on the floor surrounding the parts washer. As such, the drip pan 344 is in constant need of cleaning but due to its location immediately beneath the turntable such cleaning is made difficult. However, with the fold-up turntable 318, the drip pan 344 can be easily accessed when the door 28 is open simply by pivoting and rotating the fold-up turntable 318 as previously described.

We claim:

1. A parts washer comprising:

a cabinet defining an interior space;

means for entraining at least one of a liquid and vapor in said interior space;

an opening defined by the cabinet for accessing the interior space from externally of the cabinet;

a closure element having a top edge, a bottom edge and laterally spaced sides;

means for mounting the closure element to the cabinet for movement selectively between a) an open position wherein the interior space can be accessed through the cabinet opening and b) a closed position; and first means cooperating between the closure element and cabinet for defining a controlled flow path for at least one of a liquid and vapor in the interior space, said controlled flow path configured so that at least one of liquid and vapor in the interior space is caused to change directions as it traverses the controlled flow path.

said controlled flow path having a first section substantially adjacent to the top edge of the closure element and a second section substantially adjacent to the bottom edge of the closure element;

the first section in fluid communication with the second section to direct liquid accumulated in the first section by gravity into the second section.

the second section having means for accumulating liquid from the first section to create a liquid seal between the closure element and the cabinet over a substantial portion of the second section between the sides of the closure element.

2. The parts washer according to claim 1 wherein the first cooperating means includes a flange on one of the closure element and cabinet with a transverse leg that intercepts flow of at least one of liquid and vapor from the interior space to create turbulent movement of at least one of liquid and vapor traversing the controlled flow path.

3. The parts washer according to claim 1 wherein the controlled path extends from the interior space to externally of the cabinet.

4. The parts washer according to claim 3 wherein the first cooperating means includes a plurality of cooperating flanges defining at least a portion of the controlled flow path, said flanges being arranged so that at least one of liquid and vapor in the controlled flow path portion moves in a circuitous path against the cooperating flanges.

5. The parts washer according to claim 4 wherein at least a portion of one of the cooperating flanges has a flow guiding surface that is oriented to direct accumulated liquid thereon by gravity inwardly of the cabinet.

6. The parts washer according to claim 1 wherein the first cooperating means includes cooperating surfaces on the closure element and cabinet that define a space therebetween which define a part of the flow path that can be at least partially sealed by liquid from the interior space to thereby at least partially block movement of liquid and vapor in the controlled flow path through the space.

7. The parts washer according to claim 6 wherein the space comprises a plurality of spaces arranged such that the spaces progress from a space proximate the cabinet opening to a space distal from the cabinet opening.

8. The parts washer of claim 7 wherein the closure element has a border area and the cabinet has a frame mounted to the cabinet around the opening thereof with at least one flange extending from one of the border area and frame with said cooperating surfaces being on said flange and one of said border area and said frame in closely spaced relation to each other.

9. The parts washer of claim 8 wherein said flange comprises a plurality of flanges on the border area and a plurality of flanges on the frame wherein the flanges with the frame and border area cooperate to form a series of chambers, adjacent chambers being in fluid communication with each other through said spaces.

10. The parts washer of claim 9 wherein said chambers are arranged such that said chambers progress from a chamber proximate the cabinet opening to a chamber distal from the cabinet opening.

11. The parts washer of claim 10 wherein said proximate space is capable of providing the cabinet interior space fluid access to the proximate chamber.

12. The parts washer of claim 10 wherein said distal space is capable of providing the distal chamber fluid access to an exterior of the cabinet.

13. The parts washer of claim 8 wherein said flange, said border area and said frame are made from a non-resilient material.

14. A closure element for a parts washer including a cabinet having an interior space, the closure element having a top edge, a bottom edge and laterally spaced sides, and the closure element comprising:

means for mounting the closure element to a cabinet for movement selectively between a) an open position wherein an interior space can be accessed through an opening defined by a cabinet and b) a closed position;

means on the closure element for cooperating with a cabinet to define a controlled flow path for a fluid in the cabinet interior space; and said controlled flow path configured so that fluid in the interior space is caused to change directions as it traverses the controlled flow path.

said controlled flow path having a first section substantially adjacent to the top edge of the closure element and a second section substantially adjacent to the bottom edge of the closure element;

the first section in fluid communication with the second section to direct fluid accumulated in the first section by gravity into the second section, the second section having means for accumulating fluid from the first section to create a fluid seal between the closure element and a cabinet over a substantial portion of the second section between the sides of the closure element.

15. The parts washer according to claim 14 wherein the cooperating means includes a flange on the closure element with a transverse leg that intercepts flow of fluid from the interior space to create turbulent movement of fluid traversing the controlled flow path.

16. The parts washer according to claim 14 wherein the controlled flow path extends from a cabinet interior space to externally of a cabinet.

17. The parts washer according to claim 16 wherein the cooperating means includes a plurality of cooperating flanges defining at least a portion of the controlled flow path, said flanges being arranged so that fluid in the controlled flow path portion moves in a circuitous path against the cooperating flanges.

18. The parts washer according to claim 17 wherein at least a portion of one of the cooperating flanges has a flow guiding surface that is oriented to direct accumulated fluid thereon by gravity inwardly of a cabinet.

19. The parts washer according to claim 14 wherein the cooperating means includes surfaces on the closure element and a cabinet that define a space therebetween which define a part of the flow path that can be at least partially sealed by fluid from the interior space to thereby at least partially block movement of fluid in the controlled flow path through the space.

* * * * *